United States Patent [19]

Luitz et al.

[11] Patent Number: 4,564,211

[45] Date of Patent: Jan. 14, 1986

[54] SKI BRAKE

[75] Inventors: Max Luitz, Blaichach-Bihlerdorf; Eugen Weiss, Burgberg, both of Fed. Rep. of Germany

[73] Assignee: Ess GmbH Skibindungen, Fed. Rep. of Germany

[21] Appl. No.: 433,919

[22] Filed: Oct. 12, 1982

[30] Foreign Application Priority Data

Oct. 13, 1981 [DE] Fed. Rep. of Germany ..... 3140819

[51] Int. Cl.[4] ..... A63C 7/10

[52] U.S. Cl. ..... 280/605

[58] Field of Search ..... 280/605, 604; 188/5, 188/6

[56] References Cited

U.S. PATENT DOCUMENTS

| | | | |
|---|---|---|---|
| 4,194,758 | 3/1980 | Svoboda | 280/605 |
| 4,361,343 | 11/1982 | Luitz | 280/605 |

FOREIGN PATENT DOCUMENTS

| | | | |
|---|---|---|---|
| 2412623 | 11/1975 | Fed. Rep. of Germany . | |
| 2900531 | 8/1979 | Fed. Rep. of Germany | 280/605 |
| 8001651 | 8/1980 | Fed. Rep. of Germany . | |
| 2387061 | 11/1978 | France . | |
| 8001989 | 10/1980 | France | 280/605 |
| 2467612 | 4/1981 | France . | |
| 2483792 | 12/1981 | France . | |

*Primary Examiner*—Joseph F. Peters, Jr.

*Assistant Examiner*—Joseph G. McCarthy

*Attorney, Agent, or Firm*—Ratner & Prestia

[57] ABSTRACT

The ski brake comprises a base plate (3) on which are supported two brake levers (15, 17) between their two ends via a crossed linkage (27) pivotably about two mutually perpendicular axes. Crank arms (35) opposite the free ends (33) of the brake arms are connected in articulated manner with a foot pedal (41) whose opposite end in the lengthwise direction of the ski is linked to guidance means (45) which are guided upon the base plate (3) slideably in the lengthwise direction of the ski against the pressure of a pretensioning spring (61). In the braking position, in which the free ends of the brake levers (15, 17) project below the ski runner surface, the pretensioning force of the spring (61) is absorbed by a bearing surface (57) of the base plate (3). In the ready position, in which the foot pedal (41) is pressed down upon the base plate (3) the free ends (33) of the brake levers (15, 17) are lifted above the ski. A slide block (67) slides the foot pedal (41) via its inclined sliding surface (69) away from the crossed linkages (27) upon approaching the ready position, whereby the free ends (33) of the brake levers (15, 17) are pivoted inwardly toward the middle of the ski. During the inward pivoting movement and in the ready position, the slide block (67) likewise transfers the pretensioning force of the spring (61) to the base plate (3), so that similarly to the braking position also in the ready position the linkages of the brake levers (15, 17) are unloaded.

16 Claims, 4 Drawing Figures

SKI BRAKE

Figure 1:
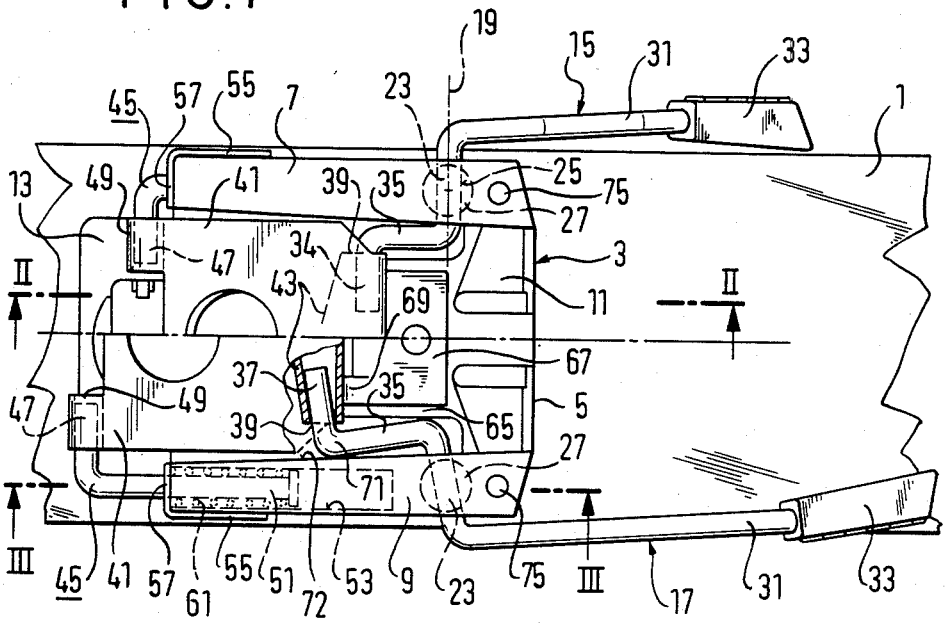

The invention relates to a ski brake having a base plate attachable to the top surface of a ski, having at least one brake lever which is mounted on the base plate so as to be pivotable between its two ends both about a first axis extending transverse to the longitudinal direction of the ski substantially parallel to the top ski surface as well as about a second axis which extends perpendicularly to the top ski surface, whose one end projects freely, having a foot pedal connected to the other end of the brake lever which is resiliently pretensioned in a braking position remote from the base plate in which the free end of the brake lever extends below the bottom ski surface and is capable of being brought against the spring pretension into a ready position adjacent to the base plate in which the free end of the brake lever is lifted into the vicinity of the top ski surface, and having, for at least one of said pedal and plate, an inclined slide surface which operates in the lengthwise direction of the ski between the foot pedal and the base plate upon approaching the ready position, and which slides the foot pedal away in order to produce a pivot movement about the second axis for the free end of the brake lever directed toward the middle of the ski lengthwise of the ski and away from said axis.

A ski brake of this type is known from German patent publication (Offenlegungsschrift) No. 2,412,623. The ski brake comprises a U-shaped base plate, on which there is mounted a unitary brake loop bent from spring wire and pivotable about transverse axes which parallel the top ski surface. As pivot shafts there serve off-set in the arms of the brake loop which extend diagonally to the longitudinal direction of the ski through slotted bearing apertures in the arms of the base plate. The off-sets are so shaped that they normally hold the brake loop in its braking position, in which the free ends of its arms extend below the bottom ski surface. To the cross member of the brake loop which is remote from the base plate in this position, there is attached a foot pedal which facilitates depressing of the brake loop. In the depressed ready position, the free ends of the brake loop are lifted approximately to the level of the top ski surface. By depressing the foot pedal from the brake position into the ready position, the brake loop, and particularly its off-sets, are elastically deformed, which pretensions the brake loop resiliently toward the braking position.

On the free ends of the arms of the base plate, there are provided inclined surfaces which coact with corresponding inclined surfaces of the foot pedal when approaching the ready position, and stretch the brake loop over its off-sets. The free ends of the arms of the brake loop thereby lie like tongs along the side edges of the ski.

In the known ski brake, the base plate bearings of the brake loop are subjected to relatively high mechanical loads. The slotted bearing apertures of the arms of the base plate must not only absorb the forces which arisew during elastic deformation of the brake loop to generate the restoring force, but are additionally loaded by the forces which arise from stretching of the brake loop in the ready position. The relatively narrow bearing surfaces of the slotted bearing are slightly deformed, so that pivoting of the free ends of the brake member arms into the ready position is no longer assured. Furthermore, the pivot angle through which the free ends can be pivoted toward the middle of the ski is relatively small. Because, in the known ski brake, the brake loop is further pretensioned toward the brake position through self-tensioning, there can also occur fatigue effects and fracture of the brake loop.

From German patent publication (Offenlegungsschrift) No. 2,906,477 a ski brake is known in which two brake levers are supported between their two ends upon a base plate, pivotably about a fixed axis extending transverse to the lengthwise direction of the ski and parallel to the top ski surface. One end of each brake lever extends freely and forms, in the braking position, a brake arm extending below the ski, while the other end is connected to a foot pedal via a linkage. Here, the pivot shaft of this linkage extends parallel to the pivot shaft of the base plate bearing. The end of the foot pedal facing away from the linkage is supported pivotably upon guidance means which are guided upon the base plate slideably in the lengthwise direction of the ski. Separate springs pretension the guidance means in such manner that the brake levers are tilted into the braking position by means of the foot pedal into its ready position, the free ends of the brake levers are lifted. In the known ski brake, the free ends of the brake levers extend beyond the ski's lateral edges in the ready position, which increases the risk of accident and injury to the skier. Moreover, the ground plate supports are impacted by the pretensioning springs in the ready position of the ski brake, which can be detrimental to their useful life.

It is an object of the invention to so improve a ski brake having free brake lever ends which can be retracted toward the middle of the ski in their ready position that the brake arms, both in the ready position as well as in the braking position, need absorb no pretensioning forces.

This object, starting from the ski brake which is more fully explained at the beginning, by connecting the brake lever with the foot pedal by a linkage which—viewed in the lengthwise direction of the ski—is positioned between the second axis of its base plate support and the middle of the ski, for pivotal movement about axes which substantially parallel the first and second axes, by having the end of the foot pedal which faces away from the linkage slidable along guidance means in the lengthwise direction of the ski, and guided along the base plate pivotably about an axis which substantially parallels the top ski surface transversely to the ski, and is pretensioned by at least one separate spring into the braking position fixed by a projection from the base plate, and by having the displacement surface engage that end of the foot pedal which supports the linkage of the brake lever. The linkage between the brake lever and foot pedal, and also the base plate linkage, are relieved of the spring's pretensioning force both in the braking position and in the ready position. In this, it is particularly advantageous that these linkages be subjected to only insignificant forces as soon as the free ends of the brake arms pivot inwardly toward the middle of the ski, since this substantially increases the life of the linkages. Upon approaching the ready position, the pretensioning forces are transferred directly to the base plate via the foot pedal and the inclined sliding surface, i.e., not by a detour via the brake lever. In the braking position, the end of the foot pedal facing away from the brake levers, or rather the guidance means by which it is supported, engages the projection from the base plate.

A preferred embodiment is characterized in that there is attached to the base plate a bearing element which is pivotable about the second axis and has a bearing aperture extending in the direction of the first axis, in that a brake arm extends freely from one end of a linkage shaft which passes pivotally through the bearing aperture, while a crank arm extends opposite the brake arm from the other end, and in that the crank arm bears a linkage pin spaced from the linkage shaft, which engages a slotted bearing aperture of the foot pedal. The slotted bearing of the crank arm upon the foot pedal has the advantage of being easy to manufacture. The bearing portion which receives the linkage shaft of the brake lever improves the strength of the base plate bearings during pivot movements about the first axis. The attachment to the base plate of the bearing portion which can pivot about the second axis is not critical, because the bearing portion is pivoted about this axis only in the unloaded state.

Embodiments which have proven to be particularly desirable are those in which the bearing portion is in the form of a cylindrical peg which rests pivotably, but axially attached in a cylindrical recess of the base plate, with its axis parallel to the second axis, and which has a bearing aperture for the linkage shaft of the brake lever perpendicular to the cylinder axis. Such pegs can be produced simply and inexpensively. Because their entire outer surface extends into the recess in the base plate, a stable base plate bearing is formed.

The brake lever consists of a stiff element, preferably made from an appropriately bent member. Because of the movement geometry of the linkage pin guided within the foot pedal relative to the linkage shaft guided within the bearing portion, the linkage shaft, upon approaching the ready position, moves in the direction of its first pivot axis relative to the linkage pin of the crank arm. In order to be able to carry out this compensating movement during inward pivoting of the free ends of the brake arms toward the middle of the ski, the linkage shaft is preferably carried in axially displaceable manner within the bearing aperture of the peg. Here the axis of the bearing aperture preferably intersects the cylinder axis of the peg.

The second, vertical pivot axis of the bearing portion can, however, also—viewed transversely to the lengthwise direction of the ski—be provided spaced from the center line of the first axis, i.e., spaced from the axis of the linkage shaft. Here the axis of the bearing aperture of the pin can extend at an angle to the cylinder axis. Alternatively, the bearing portion can be formed as a pivot arm whose one end is attached to the base plate pivotably about the second axis, and whose other end has a bearing aperture for the linkage shaft of the brake lever.

It has proven desirable that the base plate—viewed in the lengthwise direction of the ski—has at least one bearing surface oriented toward the crank arm between the crank arm and the brake arm at least in the region of the linkage pin of the crank arm, against which the crank arm bears during approach to the ready position. In this embodiment the free end of the brake lever can be pivoted especially far toward the middle of the ski. Upon approaching the ready position, the linkage pin of the crank arm is first pressed inwardly, whereby the free end pivots inwardly about the second axis of the base plate bearing toward the middle of the ski. However, as soon as the crank arm bears against the bearing surface, the whole brake lever essentially tips about the bearing point against the bearing surface, with simultaneous axial displacement of the bearing shaft of the brake lever supported by the base plate.

To prevent tilting of the foot pedal, there are preferably provided two brake levers, symmetrical with respect to the middle of the ski, while the base plate supports a slide block between the crank arms of the brake levers. The slide block preferably has two convexly curved slide surfaces which are positioned symmetrically with respect to the middle of the ski and transversely spaced from each other.

In a preferred embodiment, provision is made for the base plate to have a substantially U-shaped plastic bracket whose arms, extending in the lengthwise direction of the ski, receive between them the foot pedal in the ready position, for the one or more brake levers and the guidance means of the foot pedal to be supported by these arms, and for the inclined sliding surface to be provided on the transverse member of the bracket spaced from both arms. In this embodiment, the foot pedal lies protected between the arms in the ready position.

Manufacturing advantages are afforded by an improvement of this embodiment in which the brake lever is supported pivotably about the first axis by a bearing portion which, in turn, is seated pivotably about the second axis in a recess of the arm of the bracket open toward the ski, when the bracket is attached to a holding plate, preferably made of metal which closes this recess toward the ski. The holding plate stiffens the bracket and provides the necessary twisting stiffness for the base plate. Through the two-part construction of the base plate, assembly of the ski brake is facilitated.

Preferably, each guidance means of the foot pedal is made as an angle iron, whose first arm extending in the lengthwise direction of the ski is guided slideably in the lengthwise direction of the ski in a recess in the arm of the bracket and whose second arm forms a bearing pin engaging a bearing aperture of the foot pedal. Here the holding plate has guidance flanges which extend in front of the free ends of the bracket and are respectively slideable with respect to the first arm of the angle iron through which they extend. The free end of the first arm of the angle iron supports a counter-bearing for a spiral pressure spring encircling the first arm, which is placed under tension between the counter-bearing and guidance flange. The guidance flange simultaneously forms the abutment which determines the braking position and transfers loading forces upon the foot pedal directly to the holding plate attached to the ski. The bracket of plastic is therefore not subjected to any substantial bearing forces.

In the last mentioned embodiment, the first arm of the angle iron is preferaby seated within a recess in the arm of the bracket which is closed toward the holding plate. The holding plate is preferably connected to the bracket at least in the region of the base plate bearing of the brake lever by attaching means, particularly rivets. The number of rivets needed in this embodiment is very small, because the channel is further held aganist the holding plate by means of the angle iron. Because the first arm including the spiral pressure spring thus is seated within a closed chamber, operating difficulties due to dirt are also averted.

In a preferred embodiment, the brake lever further has a Z-shaped off-set between the base plate bearing and its free end which, in the braking position, extends substantially parallel to the lengthwise direction of the ski and, in the ready position, is raised upwardly toward the free end. In this embodiment, the free end of the brake lever can be lifted especially far above the top ski surface.

Figure 2:
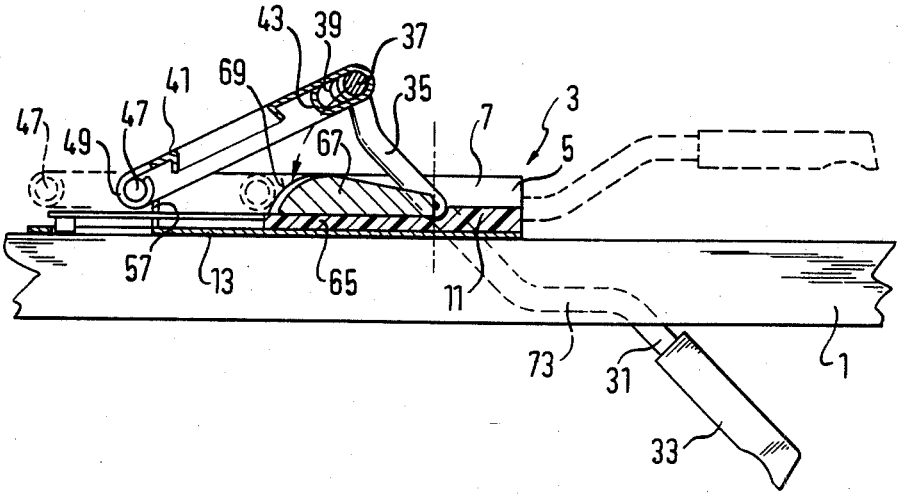
Figure 3:
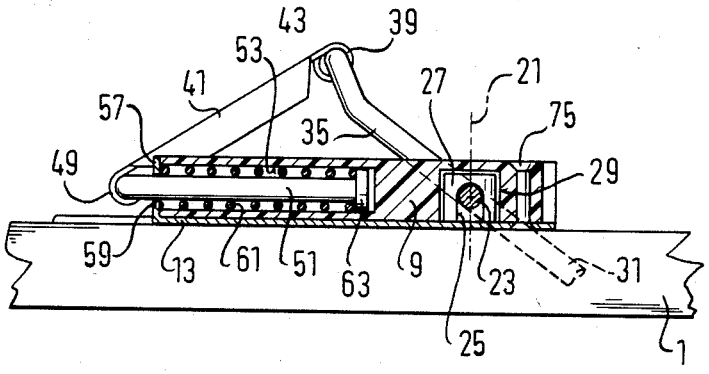
Figure 4:
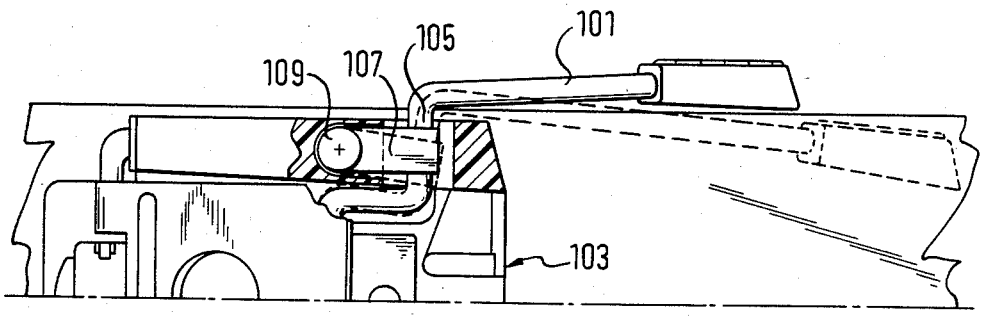

Below, an illustrative embodiment of the invention is described further with reference to drawings. There is shown in:

FIG. 1 a partially broken away top view of a first embodiment of a ski brake in which the upper portion of the figure is drawn in the braking position, the lower portion in the ready position of a ski brake;

FIG. 2 a section along the line II—II through the ski brake of FIG. 1 in the braking position;

FIG. 3 a section along the line III—III through the ski brake of FIG. 1, where the ski brake, however, is illustrated in braking position; and FIG. 4 a partially broken away top view of another embodiment of a ski brake.

In the ski brake illustrated in FIGS. 1–3 comprises, attached to a ski 1 by attaching means which are not illustrated further, a base plate 3 consisting of a U-shaped plastic bracket 5 with two arms 7 and 9 extending in the lengthwise direction of the ski, which are unitarily connected together by a flatter bridge 11. The bracket 5 is attached to a metal holding plate 13 of substantially the same outline which stiffens the bracket 5. In each of arms 7 and 9 there is supported a brake lever 15 and 17, respectively, made of a bent member and pivotable about two mutually perpendicular axes 19 (FIG. 1) and 21 (FIG. 3). The brake levers 15 and 17 are formed symmetrically with respect to the middle of the ski so that in what follows only the brake lever 15 will be described. The axis 19 extends substantially parallel to the top surface of ski 1 and, in the braking position, substantially perpendicular to the lengthwise direction of the ski.

It is determined by a linkage shaft 23 of the brake lever 15 which extends through a bearing aperture 25 in a cylindrical peg 27 open toward the holding plate 13 and closed thereby. The peg 27 is pivotably seated within a cylindrical recess 29 of the arm 7 or 9 of the bracket 5 which is open toward the holding plate 13 and closed thereby. Its cylindrical axis, which forms the pivot axis 21, extends perpendicular to the surface of the ski and intersects the axis 19.

The linkage shaft 23 extends on the outwardly positioned side of the base plate 3, bent substantially rectangularly, in the form of a freely extending brake arm 31. To the free end of brake arm 31 a plastic sheath is molded. The linkage shaft 23 extends on the inwardly positioned side of arms 7, or 9 in the form of a crank arm 35, which is bent substantially at right angles to the linkage shaft 23 and extends oppositely to brake arm 31. The crank arm 35 supports at its end facing away from linkage shaft 23 a linkage pin 37 displaced toward the middle of the ski substantially parallel to linkage shaft 23 and which extends into a slotted bearing aperture 39 of a foot pedal 41. The slotted bearing aperture 39 is formed by the transverse end of a crimp 43 in foot pedal 41 which extends spaced from arm 7. The crimp 43 becomes wider toward the middle of the ski, so that the linkage pin 37 can follow the pivotal movement of brake lever 15 or 17 about the vertical axis 21.

The end of foot pedal 41 which is opposite to the crimp 43 in the lengthwise direction of the ski is slideably guided in the lengthwise direction of the ski upon arms 7 and 9 by means of angle irons 45. The angle irons 45 respectively include one of the linkage arms 47 oriented from arms 7 or 9 of base plate 3 toward the middle of the ski, which engages a linkage loop 49 of foot pedal 41 crimped on to the foot plate 41 and located opposite to the crimp 43 in the lengthwise direction of the ski. As can best be seen from FIG. 3, the angle iron 45 is slideably guided with its other arm 51 in a cylindrical recess 53 extending in the lengthwise direction of the ski and closed toward the holding plate 13. The holding plate 13, viewed in the lengthwise direction of the ski, supports in addition to arms 7, 9 upwardly extending flanges 55 which enclose the arms 7, 9 between them. On flanges 55, guidance flanges 57 are bent in front of the free head ends of arms 7, 9. The arms 51 of angle irons 45 extend through guidance apertures 59 of the guidance flange 57 which closes recesses 53. Each arm 51 encloses a spiral pressure spring 61 which is under tension between the guidance flange 57 and a counterbearing attached to the free end of arm 51. The guidance aperture 59 is positioned at a greater distance from the ski top surface than the bearing aperture 25 of the linkage shaft 23 of brake lever 15, or 17. In compensation, the crank arms 35 are bent away from holding plate 13 between the linkage pin 37 and the linkage shaft 23.

Upon an extension 65 facing toward the foot pedal of the bridge 11 of bracket 5 there is attached a slide block 67 which has, symmetrically with respect to the middle of the ski and spaced from arms 7, 9 and from each other, two inclined slide surfaces 69, which are convexly curved toward foot pedal 41. These slide surfaces 69 cooperate with the confronting, part-cylindrical outer edge of crimp 43 and displace the foot pedal 41 which can butt against slide block 67 in the lengthwise direction of the ski.

The ski brake operates as follows:

In the braking position, the foot pedal 41 is pretensioned into the position illustrated at the top of FIG. 1 or in FIGS. 2 and 3. The rear end of foot pedal 41 connected with the crank arm 35 is remote from the base plate 3 and the brake arms 31 project below the ski runner surface. The linkage arms 47 lie adjacent to the guidance flanges 57 of the holding plate 13, thereby transferring the spring pretensioning of the pressure springs 61 directly to holding plate.13. The linkage pins 37 and the linkage shafts 23 are relieved of the pretensioning forces. During closing of the ski binding, the sole of the ski boot presses the foot pedal 41 against base plate 3. The foot pedal 41, which is guided slideably upon base plate 3 via angle irons 45, thereby slides lengthwise of the base plate 3, as shown in the lower portion of FIG. 1 and (in broken lines) in FIG. 2. The brake levers 15, 17 connected via the linkage pins 37 with foot pedal 41 first pivot exclusively about axis 19 of the linkage shafts 23, whereby the brake arms 31 are raised completely above the top ski surface.

Upon approaching the ready position, in which the ski binding is closed, the crimp 43 in the foot pedal 41 seats upon the slide surface 69 of the slide block 67. The slide block 67 slides the foot pedal 41 in the lengthwise direction of the ski in addition to the cranking geometry of the crank arms 35. The linkage shafts 23 seated in pegs 27 are thereby pivoted about the axis 21 (FIG. 3) of pegs 27, whereby the turning moment required for that purpose results from the existing spacing—viewed in the lengthwise direction of the ski—of the slotted bearing 39 from the axis 21. During the course of the pivoting movement about the axis 21, the free end 71 which faces toward the arm 7 or 9 of bracket 5 of the crank arm 35 bears against surfaces 72 of arms 7 and 9, respectively. During further sliding movement of foot pedal 41 the crank arm 35 tips about this bearing point, whereby substantially the entire brake lever 15, or 17, respectively, is pivoted toward the middle of the ski over a relatively small lever arm. In so doing, the linkage shafts 23 of the lever arms 15, 17 slide axially within bearing apertures 25 of pegs 27. During the pivoting movement upon pulling in of the brake arms 31 the foot pedal 41 is supported via sliding blocks 67 upon base plate 3 so that the bearing pins 37 and the linkage shaft 23 are free of the pretensioning of the pressure springs 61. In both end positions of foot pedal 41 these linkages are therefore unloaded, which has a desirable effect upon the life span.

The brake arms 31 exhibit between their free end and the linkage shaft 23 a Z-shaped offset having a diagonal portion 73 which, in the braking position, extends between the top and bottom surfaces of the ski parallel to the surfaces and, in the ready position, extends upwardly from base plate 3. In this way the spacing of the claws 33 from the top ski surface is increased in the ready position.

The bracket 5 is attached to holding plate 13 by rivets 75 which penetrate the arms 7 and 9, respectively, in the region of bridge 11. The free ends of arms 7, 9 are affixed to the holding plate 13 on the one hand by the flanges 55 and by the arm 51 of angle iron 45 extending through the guidance flange 57.

FIG. 4 shows another embodiment of a ski brake which differs from the ski brake which has previously been explained essentially only by the manner of bearing of their brake levers 101, only one of which is illustrated, upon a base plate 103 to be attached to the ski. The brake lever 101 is illustrated in FIG. 4 with solid lines for the braking position and with broken lines for the ready position. Its linkage shaft 105 is supported pivotably about an axis which extends in the braking position parallel to the top ski surface and perpendicular to the lengthwise direction of the ski in a bearing aperture at one end of an arm 107. The arm 107 is supported at its other end by a cylindrical pin 109 pivotably about an axis which is perpendicular to the top ski surface upon a base plate 103. The pin 109 can be rigidly connected with arm 107 and can be rotatable with respect to base plate 103 or can be rigidly connected to base plate 103 and serve as a bearing pin for the arm 107 rotatable relative thereto. The functioning and other construction of the ski brake corresponds to the ski brake of FIGS. 1–3, with the difference that the pivot shaft 105 of brake lever 101 performs no axial movement relative to the bearing aperture of the base plate bearing formed by the arm 107 and the pin 109. Rather, the linkage shaft 105 can be seated axially fixed in the bearing aperture of arm 107. Nevertheless arm 107 permits the inward pivoting of the brake lever 101.

We claim:

1. Ski brake having a base plate attached to the top surface of a ski; having at least one brake lever between two ends thereof supported on the base plate pivotably both about a first axis extending transverse to the lengthwise direction of the ski and substantially parallel to the top ski surface and also about a second axis extending substantially perpendicular to the top ski surface, one end of the brake lever extending freely; having a spring coupled at one end thereof to the base plate; having a foot pedal coupled at an end thereof to a second end of the spring and connected with the second end of the brake lever, the foot pedal resiliently pretensioned by the spring into a braking position remote from the base plate in which the free end of the brake lever projects below the bottom surface of the ski, the foot pedal moveable into a ready position adjacent to the base plate against the spring pretensioning in which the free end of the brake lever is lifted into the region of the top ski surface; and having an inclined slide surface between the foot pedal and the base plate acting in the lengthwise direction of the ski upon the foot pedal approaching the ready position to slide the foot pedal lengthwise of the ski away from the second axis and produce a pivotal movement of the free end of the brake lever about the second axis and directed toward the middle of the ski, characterized in that the brake lever is connected to the foot pedal by a linkage positioned between the second axis and the middle of the ski for the pivotal movement about the first and second axes; in that the end of the foot pedal coupled to the spring is slidable along guidance means in the lengthwise direction of the ski and is guided upon the base plate pivotably about an axis which extends substantially parallel to the top ski surface and transverse to the ski and is pretensioned by the spring in the braking position which is determined by a projection of the base plate; in that the slide surface engages the end of the foot pedal which bears the linkage of the brake lever; in that a bearing portion having a bearing aperture extending in the direction of the first axis and pivotably about the second axis is attached to the base plate; in that from one end of a linkage shaft of the brake lever which pivotably transverses the bearing aperture a brake arm extends freely and from the opposite end a crank arm is spaced oppositely from the brake arm; and in that the crank arm spaced from the linkage shaft bears a linkage pin which engages a slotted bearing aperture of the foot pedal.

2. Ski brake according to claim 1 characterized in that the bearing portion is formed as a pivot arm whose one end is attached pivotably about a second axis to the base plate and whose other end has a bearing aperture for the linkage shaft of the brake lever.

3. Ski brake according to claim 1 characterized in that the base—viewed in the lengthwise direction of the ski—has between the crank arm and the brake arm at least in the region of the linkage pin of the crank arm a bearing surface oriented toward the crank arm against which there bears the crank arm upon approaching the ready position.

4. Ski brake according to claim 1 characterized in that there are provided two brake levers symmetrical with respect to the middle of the ski; and in the base plate has a slide block between the linkages which connect the foot pedal with the brake levers.

5. Ski brake according to claim 4 characterized in that the slide block has at least one convexly curved slide surface.

6. Ski brake according to claim 5 characterized in that the slide block has two similarly shaped slide surfaces symmetrical with respect to the middle of the ski.

7. Ski brake according to claim 4 characterized in that the top surfaces of the end of foot pedal connected to the brake levers in the ready position and of the slide block have substantially similar spacing from the top ski surface.

8. Ski brake according to claim 1 characterized in that the base plate has a substantially U-shaped plastic bracket whose arms extending in the lengthwise direction of the ski receive between them the foot pedal in the ready position; in that one or more brake levers and the guidance means of the foot pedal bear against the arms; and in that the inclined slide surface is positioned spaced from both arms on a cross member of the bracket.

9. Ski brake according to claim 8 characterized in that the brake lever is supported by the bearing portion pivotably about the first axis which in turn is seated pivotably about the second axis in a recess open toward the ski in the arm of the bracket; and in that the bracket is attached to a holding plate particularly made of metal, which closes the recess toward the ski.

10. Ski brake according to claim 9 characterized in that each guidance means takes the form of an angle iron whose first arm extending in the lengthwise direction of the ski is guided slideably in the lengthwise direction of the ski in a recess in the arm of the bracket and whose second arm forms a bearing pin engaged in a bearing aperture of the foot pedal; in that the holding plate has guidance flanges which extend in front of the free ends of the bracket and are respectively slideably traversed by the first arm of the angle iron; in that the free end of the first arm of the angle iron carries a counter-bearing; and in that the spring is a spiral pressure spring which encircles the first arm and is placed under tension between the counter-bearing and the guidance flange.

11. Ski brake according to claim 10 characterized in that the first arm of the angle iron is seated in a recess closed toward the holding plate of the arm of the bracket; and in that the holding plate is connected at least in the region of the base plate bearing of the brake lever with the bracket by attaching means, particularly rivets.

12. Ski brake having a base plate attached to the top surface of a ski; having at least one brake lever between two ends thereof supported in a bearing portion on the base plate pivotably both about a first axis extending transverse to the lengthwise direction of the ski and substantially parallel to the top ski surface and also about a second axis extending substantially perpendicular to the top ski surface, one end of the brake lever extending freely; having a spring coupled at one end thereof to the base plate; having a foot pedal coupled at an end thereof to a second end of the spring and connected with the second end of the brake lever, the foot pedal resiliently pretensioned by the spring into a braking position remote from the base plate in which the free end of the brake lever projects below the bottom surface of the ski, the foot pedal moveable into a ready position adjacent to the base plate against the spring pretensioning in which the free end of the brake lever is lifted into the region of the top ski surface; and having an inclined slide surface between the foot pedal and the base plate acting in the lengthwise direction of the ski upon the foot pedal approaching the ready position to slide the foot pedal lengthwise of the ski away from the second axis and produce a pivotal movement of the free end of the brake lever about the second axis and directed toward the middle of the ski, characterized in that the brake lever is connected to the foot pedal by a linkage positioned between the second axis and the middle of the ski for the pivotal movement about the first and second axes; in that the end of the foot pedal coupled to the spring is slidable along guidance means in the lengthwise direction of the ski and is guided upon the base plate pivotably about an axis which extends substantially parallel to the top ski surface and transverse to the ski and is pretensioned by the spring in the braking position which is determined by a projection of the base plate; in that the slide surface engages the end of the foot pedal which bears the linkage of the brake lever; and in that the bearing portion has the form of a cylindrical peg which is seated rotatably but axially fixed within a cylindrical recess of the base plate with its axis parallel to the second axis and has a bearing aperture normal to the cylinder axis for the linkage shaft of the brake lever.

13. Ski brake according to claim 12 characterized in that the axis of the bearing aperture intersects the cylinder axis of the peg.

14. Ski brake according to claim 12 or 13 characterized in that the linkage shaft is seated axially displaceably in the bearing aperture of the peg.

15. Ski brake having a base plate attached to the top surface of a ski; having at least one brake lever between two ends thereof supported on the base plate pivotably both about a first axis extending transverse to the lengthwise direction of the ski and substantially parallel to the top ski surface and also about a second axis extending substantially perpendicular to the top ski surface, one end of the brake lever extending freely; having a spring coupled at one end thereof to the base plate; having a foot pedal coupled at an end thereof to a second end of the spring and connected with the second end of the brake lever, the foot pedal resiliently pretensioned by the spring into a braking position remote from the base plate in which the free end of the brake lever projects below the bottom surface of the ski, the foot pedal moveable into a ready position adjacent to the base plate against the spring pretensioning in which the free end of the brake lever is lifted into the region of the top ski surface; and having an inclined slide surface between the foot pedal and the base plate acting in the lengthwise direction of the ski upon the foot pedal approaching the ready position to slide the foot pedal lengthwise of the ski away from the second axis and produce a pivotal movement of the free end of the brake lever about the second axis and directed toward the middle of the ski, characterized in that the brake lever is connected to the foot pedal by a linkage positioned between the second axis and the middle of the ski for the pivotal movement about the first and second axes; in that the end of the foot pedal coupled to the spring is slidable along guidance means in the lengthwise direction of the ski and is guided upon the base plate pivotably about an axis which extends substantially parallel to the top ski surface and transverse to the ski and is pretensioned by the spring in the braking position which is determined by a projection of the base plate; in that the slide surface engages the end of the foot pedal which bears the linkage of the brake lever; in that there are provided two brake levers symmetrical with respect to the middle of the ski; in that the base plate has a slide block between the linkages which connect the foot pedal with the brake levers, the slide block forming the inclined slide surface; and in that the slide block has two similarly shaped slide surfaces symmetrical with respect to the middle of the ski and transversely spaced from each other.

16. Ski brake having a base plate attached to the top surface of a ski; having at least one brake lever between two ends thereof supported on the base plate pivotably both about a first axis extending transverse to the lengthwise direction of the ski and substantially parallel to the top ski surface and also about a second axis extending substantially perpendicular to the top ski surface, one end of the brake lever extending freely; having a spring coupled at one end thereof to the base plate; having a foot pedal coupled at an end thereof to a second end of the spring and connected with the second end of the brake lever, the foot pedal resiliently pretensioned by the spring into a braking position remote from the base plate in which the free end of the brake lever projects below the bottom surface of the ski, the foot pedal moveable into a ready position adjacent to the base plate against the spring pretensioning in which the free end of the brake lever is lifted into the region of the top ski surface; and having an inclined slide surface between the foot pedal and the base plate acting in the lengthwise direction of the ski upon the foot pedal approaching the ready position to slide the foot pedal lengthwise of the ski away from the second axis and produce a pivotal movement of the free end of the brake lever about the second axis and directed toward the middle of the ski, characterized in that the brake lever is connected to the foot pedal by a linkage positioned between the second axis and the middle of the ski for the pivotal movement about the first and second axis; in that the end of the foot pedal coupled to the spring is slidable along guidance means in the lengthwise direction of the ski and is guided upon the base plate pivotably about an axis which extends substantially parallel to the top ski surface and transverse to the ski and is pretensioned by the spring in the braking position which is determined by a projection of the base plate; in that the slide surface engages the end of the foot pedal which bears the linkage of the brake lever; and in that the brake lever has a Z-shaped offset between the base plate bearing and its free end, whose diagonal portion extends substantially parallel to the lengthwise direction of the ski in the braking position and rises upwardly toward the free end in the ready position.

* * * * *